US007273200B2

(12) United States Patent
Funes Gavilan

(10) Patent No.: US 7,273,200 B2
(45) Date of Patent: Sep. 25, 2007

(54) SAFETY EQUIPMENT FOR BUILDING SITES

(76) Inventor: Tomas Funes Gavilan, Dr. Buxò, 11, E-08110 Montcada I Reixac, Barcelona (ES)

( * ) Notice: Subject to any disclaimer, the term of this patent is extended or adjusted under 35 U.S.C. 154(b) by 0 days.

(21) Appl. No.: 10/547,016

(22) PCT Filed: Feb. 24, 2004

(86) PCT No.: PCT/ES2004/000080

§ 371 (c)(1),
(2), (4) Date: Oct. 11, 2005

(87) PCT Pub. No.: WO2004/076777

PCT Pub. Date: Sep. 10, 2004

(65) Prior Publication Data

US 2006/0108176 A1 May 25, 2006

(30) Foreign Application Priority Data

Feb. 26, 2003 (ES) ..... 200300462

(51) Int. Cl.
*A47F 5/00* (2006.01)

(52) U.S. Cl. ..... 248/354.1; 248/354.3; 248/354.4; 248/354.7; 256/59; 256/65; 256/65.01; 256/68; 256/DIG. 6; 254/102

(58) Field of Classification Search ..... 248/354.1, 248/354.3, 354.4, 354.7; 256/65, 59, 65.01, 256/68, DIG. 6; 52/DIG. 12; 254/102; 182/2.1, 2.11, 27
See application file for complete search history.

(56) References Cited

U.S. PATENT DOCUMENTS

| | | | | |
|---|---|---|---|---|
| 3,335,987 | A * | 8/1967 | Woolslayer et al. | 248/649 |
| 3,439,898 | A | 4/1969 | Cleveland et al. | 256/39 |
| 3,589,682 | A * | 6/1971 | Dickey | 256/59 |
| 3,662,993 | A * | 5/1972 | Lionetto | 256/65.13 |
| 3,734,467 | A * | 5/1973 | Weeden | 256/65.04 |
| 3,822,850 | A * | 7/1974 | Elias | 248/551 |

(Continued)

FOREIGN PATENT DOCUMENTS

| | | |
|---|---|---|
| ES | 2 128 915 | 5/1999 |
| ES | 1 048 984 | 10/2001 |

*Primary Examiner*—Carl D. Friedman
*Assistant Examiner*—Todd M. Epps
(74) *Attorney, Agent, or Firm*—Ostrolenk, Faber, Gerb & Soffen, LLP

(57) ABSTRACT

The invention relates to a construction safety assembly. The inventive assembly comprises: safety posts with non-skid ends, which are provided with means for the rapid connection of a barrier; and, optionally, an upper jack-type safety element having a lower horizontal protrusion along an inclined plane, which is used to brace the cornice or projecting element of a building and which can also comprise the aforementioned barrier connection means. The adjustable-length barrier comprises a base which covers the lower part thereof. In this way, the invention provides a dual safety assembly of very simple construction, which can be used to guarantee the collective safety of labourers performing external and internal construction work and prevent accidents.

7 Claims, 3 Drawing Sheets

U.S. PATENT DOCUMENTS 3,883,106 A * 5/1975 Simonsen ..... 254/106
4,576,354 A * 3/1986 Blessing, Sr. ..... 248/354.5
4,688,686 A * 8/1987 Mitts et al. ..... 211/183
5,031,724 A * 7/1991 Quinn ..... 182/186.6
5,297,779 A * 3/1994 Collins et al. ..... 254/98
2006/0022186 A1* 2/2006 Melic ..... 256/24

* cited by examiner

SAFETY EQUIPMENT FOR BUILDING SITES

CROSS REFERENCE TO RELATED APPLICATION

The present application is a 35 U.S.C. §§ 371 national phase conversion of PCT/ES2004/000080, filed 24 Feb. 2004, which claims priority of Spanish Application No. R200300462, filed 26 Feb. 2003. The PCT International Application was published in the Spanish language.

BACKGROUND OF THE INVENTION

This is formed by safety posts with non slip ends which are equipped with rapid connection parts for fencing and with the option of an upper safety part in the form of a jack with a lower, horizontal, inclined extension to be attached to a building's cornice or protuberance which may also include these fencing connection methods. They may be extended in length and include a base which covers the lower part of the same.

It's very simple construction means that it is possible to guarantee the overall protection of workers on outdoor and indoor building sites, preventing accidents with the invention's safety equipment.

This appplication for an Invention Patent consists of, "SAFETY EQUIPMENT FOR BUILDING SITES" as stated in the title which has been constructed, set out and designed to fulfil the purpose fpr which it has specifically geen designed, with maximum degree of safety and effectiveness and providing numerous advantages as shown in this document.

The high rate of accidents in the building industry arising from the high degree of risk in the work carried out (by its very nature and by the nature of the site where it is carried out) is currently a very serious problem. Accidental falls on building sites, particularly falls from a great height, plus being hit by objects, are currently the main risks to workers on a building site.

Awareness about the high degree of risk in the construction industry has been increasing over recent years. A significant degree of effort has been put into protection equipment such as nets and other similar equipment in order to prevent injury. Also access to the building site has to be maintained in a good condition, there have been improvements and increases in signage as well as showing precautions to be taken on the building site. Nevertheless, these safety measures are unfortunately still insufficient to reduce the site accident rates in the industry.

On building sites which use posts before and/or after shuttering the building, after the floors have set, the risk of the worker falling, (perhaps through tripping accidentally on the floor, through, for example, becoming unbalanced after straining too hard, or through fainting, etc) is very high because of the gaps between posts, particularly when this space opens out onto a long drop, creating a significant potential risk. Usually this gap is partially covered with wooden planks, iron bars, nets or it is left without being covered. This is not a solution to the problem at all.

Therefore there is potentially serious danger for builders on a building site because of these gaps between posts. Wooden planks or iron bars which are normally available to cover the space between adjoining posts offer minimal safety on a building site and simply act as 'reassurance', that is to say visual symbols for the worker warning him that there is a danger present. These measures are insufficient to prevent accidents on a building site.

To solve this problem this invention proposes safety equipment for building sites which has been specially designed to protect all workers on indoor and outdoor building sites.

SUMMARY OF THE INVENTION

It consists of safety equipment to be used on a building site subsequent to the shuttering stage, after the floor has set. As will be shown later, the advantageous features of the safety equipment in this invention mean that it is also likely to be used for building being renovated as well as during interior decoration work.

The safety equipment in the invention basically comprises of a series of safety posts built from telescopic tubular bodies equipped with supporting surfaces and locking mechanisms to prevent relative movement between the posts after they have placed in position. The layout of the telescopic tubes offers a wide range of heights. It must be remembered that these safety posts do not have the same function as the posts which are usually used on sites. The posts commonly used as supporting parts are specially designed to withstand axial compression loads. Posts are generally used to hold up construction work during maintenance or renovation work. However, safety posts in this invention are designed to support side impacts and not to avoid slide sideways when receiving impacts, vibrations and the possibility cracks in the construction work drying out. Therefore, according to the invention, the upper end of the safety post has non-slip surfaces which in one example may be a rubber or similar material surface on the upper end of the safety post and a rough surface on the lower end or base which allows the safety post to be fixed on the building site. The lower end may be made into a foot with extensions going down to anchor the safety post on to the untreated surface of new building work for example.

On the other hand, the side area on at least one of these pieces of equipment has the means to rapidly connect a fence using the transverse mechanism to join it to the safety posts. This fencing or rail offers the required safety to guarantee protection around the outside of the building site as well as providing access to interior stairways for instance, lift shafts and flat roofs. The layout of the banister as overall protection equipment prevents potentially fatal falls. In order to achieve this, the aforementioned banister as part of the safety equipment is designed to withstand weight and impact from the employees and building equipment present on the site.

In some scenarios it may be necessary to adapt the fencing to different gaps between safety posts. To do this and in accordance with the invention's safety features, the aforementioned fencing comprises a horizontal bar structure and other reinforcing bars, in such a way that these bars may be extended in length to vary the operating length of the fencing.

As an option, the invention may be equipped with an upper safety part which is especially adapted to connect a safety fence in such areas as a house's balcony or similar locations where there are no safety posts. This upper safety part comprises a vertical holding piece with the lower end having a horizontal extension ending in an inclined plane. The aforementioned upper holding piece on the safety equipment includes a horizontal part which moves vertically along it and is equipped with a locking mechanism. The configuration of this vertical holding piece lets a cornice or a protuberance on a building to be captured between the aforementioned horizontal extension and the moveable horizontal part as though it were a chuck. By doing this, the aforementioned inclined plane is properly supported on the upper end of the safety post. Therefore, the vertical holding piece remains fixed throughout the building work. The aforementioned inclined plane, which is in the shape of a disc, may include a rubber safety base between it and the end of the safety post which it can rest on to prevent any of the parts from moving as happens with the aforementioned safety post. The vertical holding piece has rapid connection parts like the transversal fencing in accordance with the other parts of the invention. These connections allow fencing to be located in higher areas of the building work, above the safety posts, on balconies for example. Therefore the invention can become very simply constructed, highly effective dual safety equipment.

The way the equipment has been invented means that the safety fencing includes a base or kick plate covering its lower section. The kick plate is designed to stop objects from falling onto people on the building site or to prevent an employee getting past it and removing the base to get inside the fencing. It is therefore, a part which reinforces the safety equipment's safety.

As previously stated, the invention has locking equipment designed to prevent movement between the aforementioned telescopic tubes on the safety posts. The preferred configuration for this locking equipment will essentially include a tubular part which will fit tightly around the central part of the safety post where it holds together both tubes. This tubular part is threaded on the inside to be able to fit an outer thread on the upper end of the lower tube. In this way turning the tubular part to tighten it moves it vertically toward the upper tube to butt up against a rod located in its opening to prevent the safety post tubes from moving.

Preferably, this tubular part has at least one side opening to house a lever key which has been designed to rotate it. This is a special key which is located inside a container on each floor of the building. This container will be a striking colour so that it can be found easily and therefore may be used on the safety post. Once the key has been used, the operator must return it to the container. This obliges the employee to be aware of the importance of safety on the building site.

In order to simplify the equipment and to make it easy to assemble, the rapid connection devices on the aforementioned fencing are made from hooks designed to be located in the openings on the fencing. A specific example of this would mean that these rapid fencing connection devices are pairs of hooks on the side of each safety post tube which are designed to be put into the respective pairs of holes on the fences forming them into a right angle. Here, each hook in the pairs of hooks is welded to the safety post at different heights to prevent interference between the aforementioned fencing.

The rapid fencing connection devices on the invention are on every tube on each safety post so that the safety post may connect fencing at different heights. This guarantees safety on the building site in any situation and for any type of work being carried out.

BRIEF DESCRIPTION OF THE DRAWINGS

The features and advantages of the safety equipment in this invention will be evident from the detailed description of its preferred configuration shown below. This is a non-limiting example and includes the attached drawings.

DESCRIPTION OF PREFERRED EMBODIMENTS

The parts used in the preferred configuration of the invention are described below:

(1) Safety post;
(2) Lower tube;
(3) Upper tube;
(4) Safety post locking mechanism;
(5) Fencing rapid connection mechanism;
(6) Fencing;
(7) Upper safety piece;
(8) Vertical holding piece;
(9) Horizontal extension;
(10) Inclined plane disc;
(11) Vertically moving horizontal piece;
(12) Moveable horizontal piece locking mechanism;
(13) Building cornice or protuberance;
(14) Rubber safety base;
(15, 16) Horizontal fencing bars;
(17, 18, 19) vertical fencing bars;
(20) Reinforcing fencing bars;
(21) Kick plate;
(22, 23) Safety post tube ends;
(24) Non-slip safety post piece;
(25) Safety post locking tube mechanism;
(26) External thread on the upper end of the lower safety post tube;
(27) Rod;
(27*a*) Rod safety lock;
(28) Upper tube openings;
(29, 30) Side openings on safety post locking tube mechanism; and
(31) Special lever key.

Figure 3:
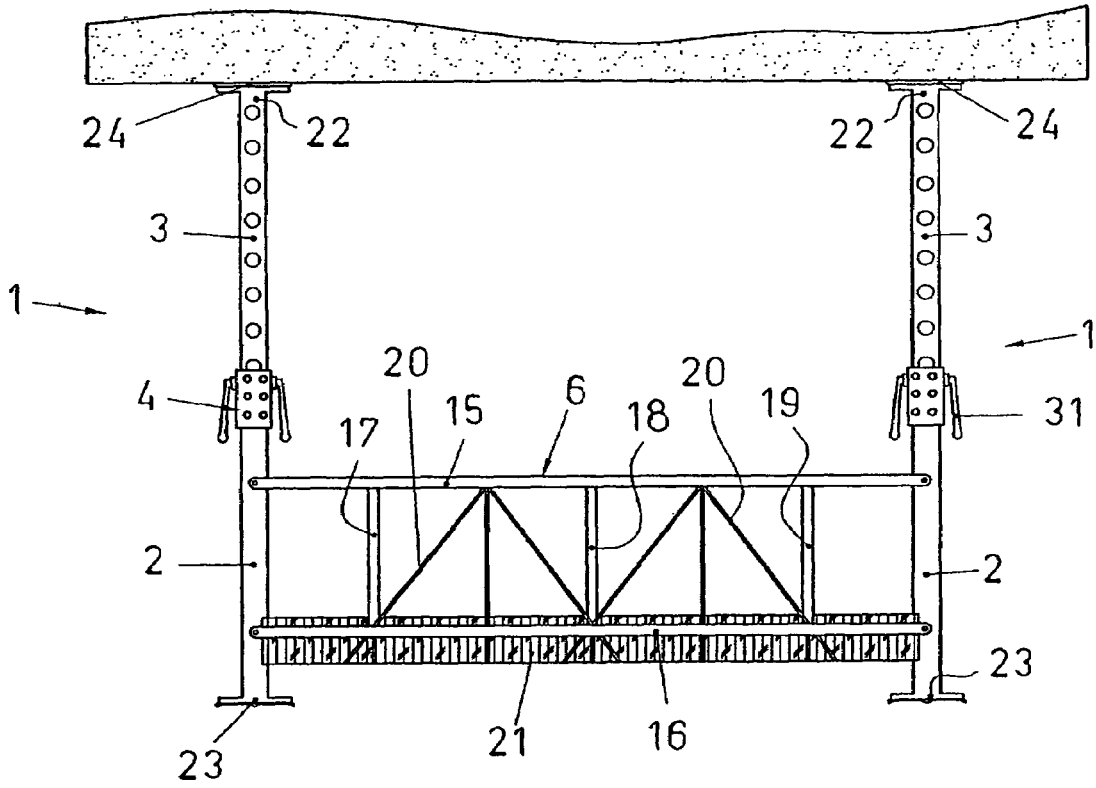
FIG. 3 is a front view of the invention's safety equipment.

Safety equipment comprising a series of vertical safety posts will be described. These safety posts (1) will be separated as illustrated in FIG. 3 attached to this report. This diagram shows two of the aforementioned posts (1). The safety posts (1) in the safety equipment in the invention is painted in a striking colour so that it can be easily detected in a danger zone by the operator, for example, fluorescent orange. Each safety post (1) shown basically comprises of a lower tube (2) and upper tube (3) which is held in position by sliding it inside the lower tube (2) telescopically in order to obtain different heights. In the middle area there are mechanisms (4) to prevent movement between the tubes (2, 3). These mechanisms are described in more detail below.

These safety posts (1) have mechanisms (5) for the rapid connection of a fence (6) in a transversal position in terms of each safety post (1). In the example, the fence (6) is up to 3 metres long and its configuration may be clearly seen in FIG. 4 of the drawings. As these drawings show that the rapid fencing connection mechanisms (5) are made up of hooks (in the example shown). These hooks may be anywhere along the lower tube (2) and on the upper tube (3) (or on both) depending on the degree of coverage required by the building site. In every situation the fencing (6) covers the existing gap between two adjoining safety posts (1) to great effect. This provides the required safety to guarantee protection around the outside of the building site, stairways, lift shafts and other locations on the building site. The configuration of the fencing (6) shall be described in greater detail in terms of FIG. 4 of the drawings.

Figure 5:
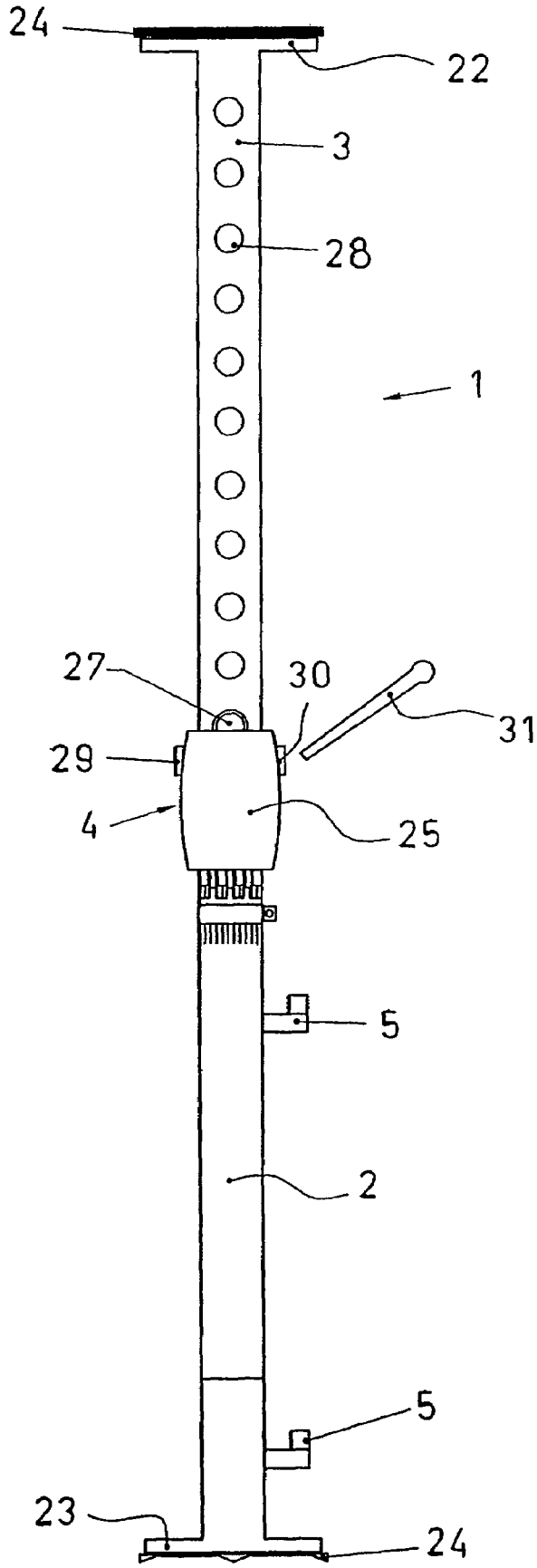
FIG. 5 is an enlarged side view of the invention's safety post shown without the fencing.

A significant feature of the invention and referring to FIG. 5 of the drawings is the upper end (22) and lower end (23) of the safety posts (1) in the invention. These are equipped with the relevant non-slip surfaces (24). The lower part of the lower tube (2) on the safety post (1) has a metal foot grip or a grooved or rough shoe extending downwards to improve the anchoring of the safety post (1) onto the ground of the building site. More specifically the upper end (22) of the safety post (1) may have a grooved rubber base (24) while the lower end (23) of the safety post (1) may have a grooved rubber foot with thick studs (24). This configuration makes the invention safer because each safety post (1) can effectively absorb blows and vibrations, preventing the posts (1) from sliding sideways on impact and also absorbing possible cracks when the building work dries out.

Figures 1, 2:
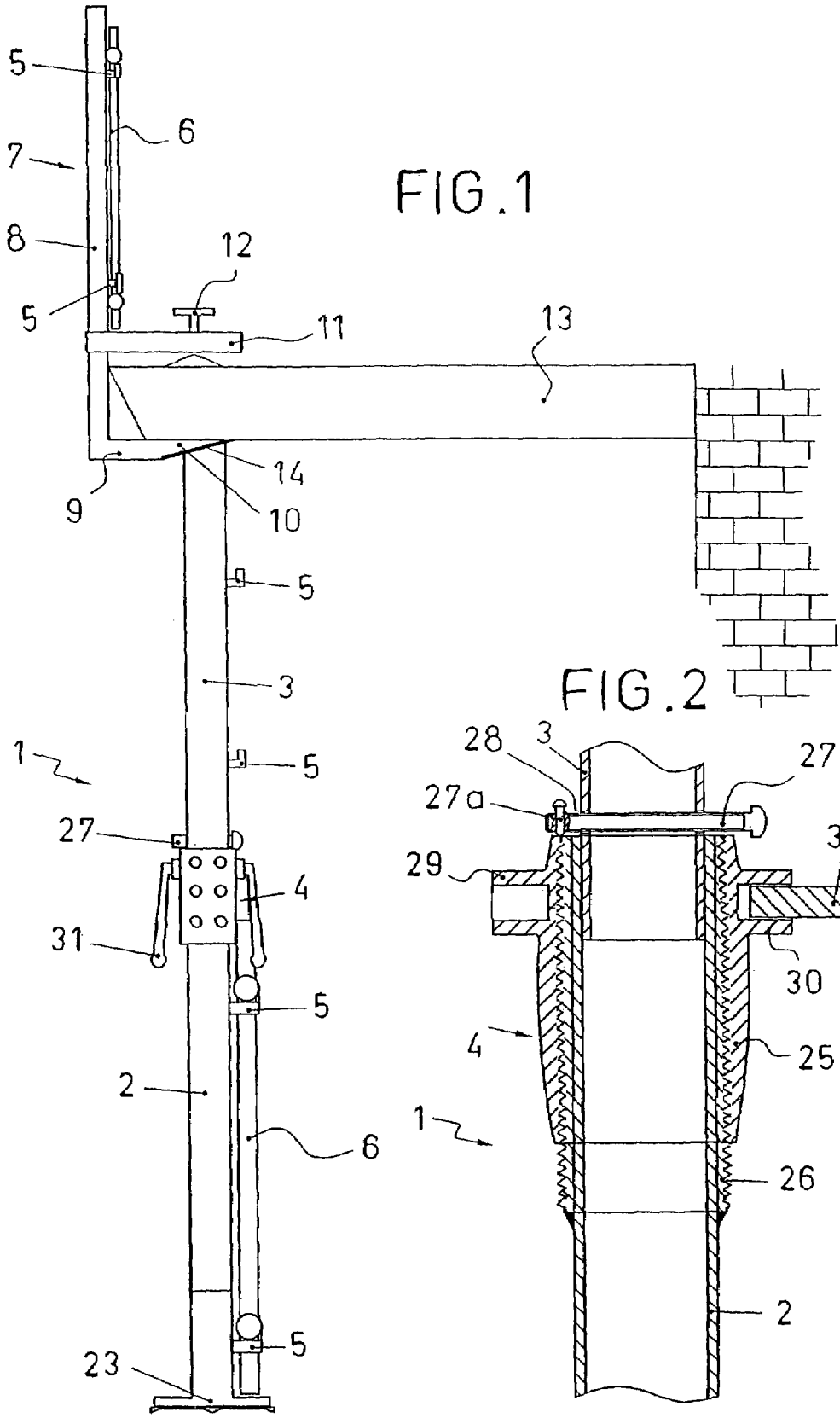
FIG. 1 is a side view of a safety post in the invention equipped with fencing and a vertical holding piece which is also supplied with the fencing.
FIG. 2 is a partial enlarged cross-section of the locking mechanism to prevent movement between the telescopic safety post tubes.

With particular to FIG. 1 in the drawings, the invented piece of equipment also has the option of an upper safety piece, called (7) in drawing number 1. The upper safety piece (7) comprises a vertical holding piece (8) at the lower end of which is a horizontal extension (9) ending in an inclined plane disc (10). The upper safety piece also has a vertically moveable horizontal piece (11) and is equipped with mechanisms (12) to lock this part in a vertical position with regard to this vertical holding piece (8). As FIG. 1 in the drawings attached to this report shows, the aforementioned upper safety piece (7) allows the external section of a building's cornice or protuberance (13) to be trapped between the aforementioned horizontal extension (9) and the moveable horizontal piece (11). The trapping of the building's cornice or protuberance (13) between the horizontal extension (9) and the vertically moveable horizontal piece (11) occurs because of downward compressive force exerted by locking mechanisms (12) onto the vertically moveable horizontal piece (11) and upward compressive force exerted by locking mechanisms (4) through upper tube (3) and rubber safety base (14) onto the inclined plane disc (10), and the horizontal extension (9), such trapping also connecting the upper safety piece (7) with the safety post (1). The assembled position shown demonstrates that the lower surface of the inclined plane disc (10) is supported on the upper end of the safety post (1) so that the vertical holding piece (7) remains fixed during the building work due to the locking mechanisms (12) which, by way of an example may be a screw, (although other equivalent locking mechanisms are possible). The disc (10) includes a rubber safety base (14) assembled between the disc itself (10) on the horizontal extension (9) and the upper end of the tube (3) on the safety post (1) This prevents the relative movement and vibration of the different parts.

As with the upper and lower tubes (3, 2) on the safety post (1), the upper holding piece (7) also has traversal fencing (6) and rapid connection mechanisms (5). This allows fencing (6) to be located in upper areas of the building work above safety posts (1) as seen in FIG. 1.

Figure 4:
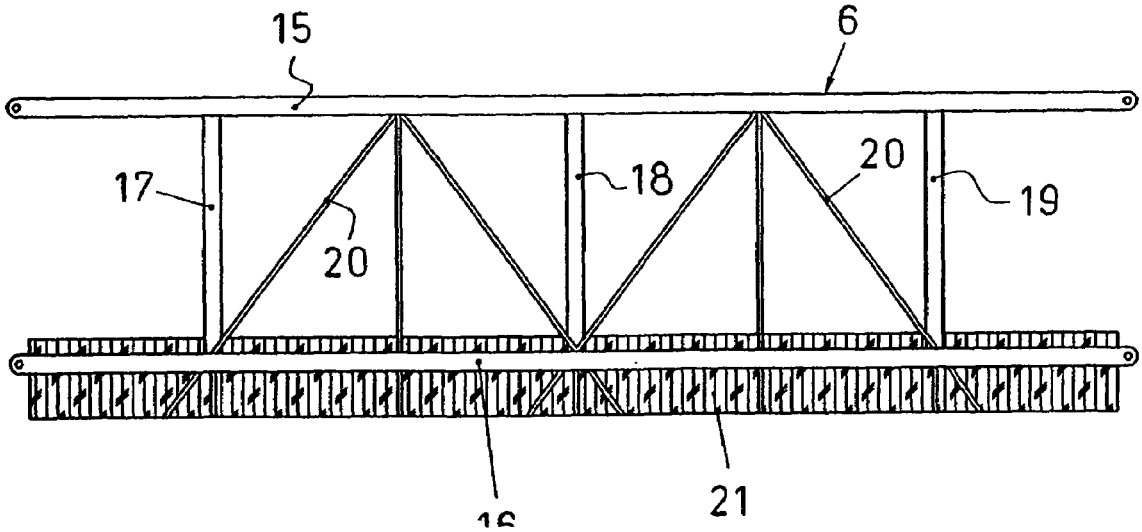
FIG. 4 is a front view of the invention fencing safety equipment.

FIGS. 3 and 4 shows that the traversal fencing (6) with the safety equipment has a relatively lightweight structure comprising vertical bars (17, 18, 19) and reinforcing bars (20). Sometimes the fencing might have to be adapted to different gaps between the safety posts (1) although this is not illustrated. In order for it to be able to do this, it is envisaged that the fencing structure may be extended lengthways to change its operating length. This scenario allows this safety equipment invention to be used on renovation and interior decoration work. By way of an example, the equipment may be effectively used for repairing balcony ceilings, attaching awnings and changing balustrades, etc., where the safety equipment on the upper section of the balcony covers the gap where an employee working above the height of the balcony fencing may fall.

On the lower part of the aforementioned fencing (6) there is a base or foot (21) which covers the lower part of the fencing (6) to prevent objects falling off which may accidentally injure an employee. The base (21) may be a strip of canvas stretched between the end upright bars on the fencing (6). This may also be a metal or plastic plate or any other type of suitably strong material. The base (21) may also be made from a combination of materials, for example, an area of canvas plus a lower band of another suitably rigid material.

As previously stated, the invention also has locking mechanisms (4) on the safety posts (1) which prevent the backward movement of the tubular parts (2, 3). FIGS. 2 and 5 show that these mechanisms (4) include a tight fitting tubular piece (25) which surrounds the central part of the safety post (1) where the two tubes fit together (2, 3) as seen in FIG. 5. The tube is threaded on the inside (25) in order for an outer thread (26) on the upper end of the lower tube (2) to be screwed onto it as shown in FIG. 2. Turning the tube (25) in the tightening direction moves it vertically towards the upper tube (3) butting up against a rod (27) (or hiding a locking pin) which is housed in the opening (28) to prevent the aforementioned tubes (2, 3) on the safety posts from moving. The rod (27) is locked by the safety locking part (27*a*) to prevent it from accidentally falling out of the safety post (1).

As can be seen in FIG. 2, the tube (25) has a pair of side openings (29, 30) where the special lever keys (31) are placed. This (31) key is designed to turn the tube (25)and is to be stored in a container (not shown) on each floor of the building. After the key (31) has been used, the operator returns it to the aforementioned container so that everyone is aware of the importance of safety on a building site.

Having sufficiently described the details of the safety equipment in this invention using the attached drawings, it is understood that appropriate changes to the details of the invention may be made, whenever the essential features of the summarised invention are not altered.

The invention claimed is:

1. Safety equipment for building sites including several safety posts and fencing, the fencing being attached between adjacent safety posts, each of said safety posts comprising at least two telescopic tubes equipped with a locking mechanism to prevent the post from moving, each of the safety posts having hooks on the side for connecting to openings in the fencing, the fencing comprising a structure of horizontal bars and reinforcing bars, wherein the safety equipment further includes an upper safety piece comprising a vertical holding piece having a lower end which has a horizontal extension ending in an inclined plane, the upper safety piece further including a vertically moveable horizontal piece and locking equipment for the vertically moveable horizontal piece, the upper safety piece being designed to trap a building's cornice or protuberance between the horizontal extension and the vertically moveable horizontal piece using the inclined plane, the inclined plane being supported on the upper end of the safety post.

2. Safety equipment for building sites according to claim 1, wherein the upper safety piece is equipped with hooks for rapid connection of transverse fencing.

3. Safety equipment for building sites according to claim 1, wherein the locking mechanism prevents movement of the telescopic tubes on the safety post, the locking mechanism including a tight fitting tubular part surrounding the central part of the safety post where the telescopic tubes join, the tight fitting tubular part being threaded on the inside to join with an outside thread on an upper part of the lower telescopic tube, so that when the tight fitting tube is turned to tighten the tight fitting tube, there is a vertical movement of the tight fitting tube towards the upper telescopic tube until the tight fitting tube butts up against a rod housed in an opening in the upper telescopic tube, the tight fitting tube having at least one side opening to locate at least one lever key which turns the tight fitting tube.

4. Safety equipment for building sites according to claim 1, wherein hooks are in pairs on the safety post to be placed into openings on the fencing, each hook in these pairs being at a different height to prevent the hooks from interfering with the fencing.

5. Safety equipment for building sites according to claim 1, wherein the horizontal bars are extendible in length to vary the operating length of the fencing.

6. Safety equipment for building sites according to claim 1, wherein the locking mechanism prevents the movement of the telescopic tubes on the safety post, the locking mechanism including a tight fitting tube to lock the position of the telescopic tubes.

7. Safety equipment for building sites according to claim 3, wherein the locking mechanism, preventing the movement of the telescopic tubes on the safety post, includes a safety locking part to prevent the rod from falling out of the safety post.

* * * * *